United States Patent [19]

McInnis

[11] Patent Number: 4,795,857

[45] Date of Patent: Jan. 3, 1989

[54] WATERPROOF HOUSING FOR THE SPLICED ENDS OF ELECTRICAL CABLES

[75] Inventor: Patrick M. McInnis, Gardnerville, Nev.

[73] Assignee: GardenAmerica Corporation, Carson City, Nev.

[21] Appl. No.: 150,241

[22] Filed: Jan. 29, 1988

[51] Int. Cl.[4] ..... H01R 4/22; H01R 13/506; H01R 13/52

[52] U.S. Cl. ..... 174/138 F; 174/76; 174/87; 174/92; 439/521; 439/731

[58] Field of Search ..... 174/76, 87, 92, 138 F; 439/199, 203, 204, 367, 519, 521, 687, 696, 731, 752, 892, 906, 936

[56] References Cited

U.S. PATENT DOCUMENTS

| | | | |
|---|---|---|---|
| 2,329,442 | 9/1943 | Popp | 439/731 X |
| 2,894,056 | 7/1959 | Bogese | 174/92 |
| 3,115,541 | 12/1963 | Hanner et al. | 174/92 |
| 3,879,575 | 4/1975 | Dobbin et al. | 174/92 |
| 4,029,896 | 6/1977 | Skinner | 174/92 X |
| 4,337,374 | 6/1982 | Smith | 439/521 X |
| 4,423,918 | 1/1984 | Filreis et al. | 439/521 X |
| 4,451,696 | 5/1984 | Beinhaur | 174/76 X |
| 4,610,738 | 9/1986 | Jervis | 439/204 X |

*Primary Examiner*—Laramie E. Askin

*Attorney, Agent, or Firm*—Keith D. Beecher

[57] ABSTRACT

A waterproof housing which is intended to be buried in the ground, and which serves to protect the splices of buried electrical cables such as are used, for example, in irrigation control systems. The housing is formed of two identical half-sections configured to snap together around the crimped splice of two or more cables. Each half-section is pre-filled with a plastic insulating gel which becomes adhesively attached to the crimping sleeve of the splice and which forms a perimeter seal around the splice. Troughs are provided at one end of each section as a means of entry for wires to be spliced. Thin frangible dams are molded onto the outer ends of the troughs to maintain the gel in the half-sections during filling, and which are crushed by the cables when the two half-sections are pressed together.

1 Claim, 3 Drawing Sheets

WATERPROOF HOUSING FOR THE SPLICED ENDS OF ELECTRICAL CABLES

BACKGROUND OF THE INVENTION

Protection for the spliced ends of electric cables is a major concern for electrical contractors, especially when the cables are buried in the ground. A variety of protective devices for this purpose are known to the art. Such prior art devices are illustrated and described, for example, in U. S. Pat. Nos. 3,597,528 and 3,937,870.

The prior art devices, for the most part, comprise a generally tubular member or casing having a side wall, a closed end wall, and an open end, and a second member or plug adapted to mate with the tubular casing and close off the open end of the casing. Passages are provided in either the end wall of the casing or in the end of the plug to permit the conductors to extend into the casing. A bonding and insulating compound or adhesive is disposed within the casing to bond the casing and plug together. This compound substantially fills the interior of the casing and anchors and bonds the conductors in the casing, and it also provides further electrical insulation for the spliced conductors.

While the prior art devices described in the preceding paragraph have many desirable features, the problem of providing a good and reliable weather-tight protective housing for the spliced ends of submerged electrical cables has not been satisfactorily solved in the prior art. One major problem resides in the flow of the uncured bonding or potting compound around the conductors and through the end wall passages during the assembly of the plug and casing, while the compound is in liquid form. This flow results in a weakened bond between the conductor and the walls of the casing, and also often results in voids or openings through which moisture may enter the casing and cause short circuits to the electrical circuit formed by the connection between the conductors.

Another problem in the prior art devices resides in the possibility of a separation of the plug from the casing after assembly. This separation may result from internal pressures created by the assembly of the plug and casing and by the evolution of gases during curing of the potting compound. If the plug separates appreciably from the casing, there will be no effective bonding of the casing and plug, and leakage paths to the interior of the device are created through which moisture may enter into the casing.

BRIEF DESCRIPTION OF THE INVENTION

The waterproof housing assembly of the present invention represents a distinct improvement over the prior art devices. Unlike the prior art devices, the housing of the invention is formed of two identical half-sections which snap-fit with one another. The construction is such that the assembled half-sections of the housing of the present invention are rigidly held together and are not subject to separation when in use. However, the sections may be separated by an appropriate tool for maintenance or troubleshooting purposes.

The housing of the invention has the primary function of containment of a gel, and the support and protection of the spliced wires contained in the housing. The housing is constructed to allow the two half-sections to be pre-filled with gel. Then, when the two half-sections are snapped together around a crimped wire connection, they form a complete waterproof housing. The half-sections may be formed of molded thermoplastic to provide structural strength, electrical insulation, flexibility for the snap-fit, and resistance to corrosion. A manufacturing advantage is gained by molding a single part to form each half-section, in that the half-sections can be handled in bulk and simply counted out into even numbers for assembly kits.

Each half-section of the housing is pre-filled with appropriate gel, as mentioned above, which, when set, has no tendency to flow out of the half-sections. A suitable gel is a silicone based polymer that is formulated for a high degree of surface tackiness so that it sticks to the housing, to itself, to the wires, and to the crimped sleeve which serves to splice the wires together. This tackiness allows the gel to form a reliable perimeter seal around the entire splice. The gel formulation is such that the compound does not harden over time or temperature, or melt at high temperatures or freeze at normally encountered low temperatures. Such a gel is presently being manufactured by the Raychem Corporation of Menlo Park, Calif., and marketed under the trademark "GelTek". This gel is chemically stable and impermeable to water, and it does not harden or melt in service. Even though the gel has a high propensity to stick to itself, it will separate when the half-sections of the housing are separated. The splice may be held in place by a commercial pressure crimp sleeve of copper alloy with tin plating. The sleeve will accommodate a number of different combinations of wires and wire sizes.

A number of troughs are built into one end of each half-section as a means of entry for the wires to be spliced. The size of the troughs is such that a number of different sized wires can be spliced either in multiples of the same size or in combinations of different sizes. The maximum and minimum wire sizes are determined by the size of the troughs and the level of fill of the gel. Thin frangible dams are molded onto the outer ends of the troughs as a means of keeping the gel in during filling and to allow for the containment of the gel in the bottom of the troughs for sealing. The wires to be spliced and crimped are then laid between the two halves of the assembly, with the crimp engaging the gel. The two halves are then squeezed together, causing the wire insulation to deform or break the dams allowing excess displaced gel to flow out around the wires.

The housing assembly of the invention also incorporates features necessary to form a reliable perimeter seal of the gel around the wire splice and the wire insulation. These features include an interlocking divider that extends between each pair of wires entering the housing to prevent the crimp from being pulled out of the housing or out of the gel cavity far enough to defeat the seal, and blades that extend up above the mating surface of each half-section of the housing serve as displacers of the gel thereby moving the gel towards the crimp to ensure sealing. Specifically, the blades enter the gel and force it towards the center of the cavity where the crimped wires are positioned. The blades serve a second function of preventing the half-sections of the housing from nesting in large clusters during bulk handling, in that they provide a surface for the other half-sections to rest upon, rather than on the gel which otherwise would cause the half-sections to stick to one another during such bulk handling.

DETAILED DESCRIPTION OF THE ILLUSTRATED EMBODIMENT

Figure 1:
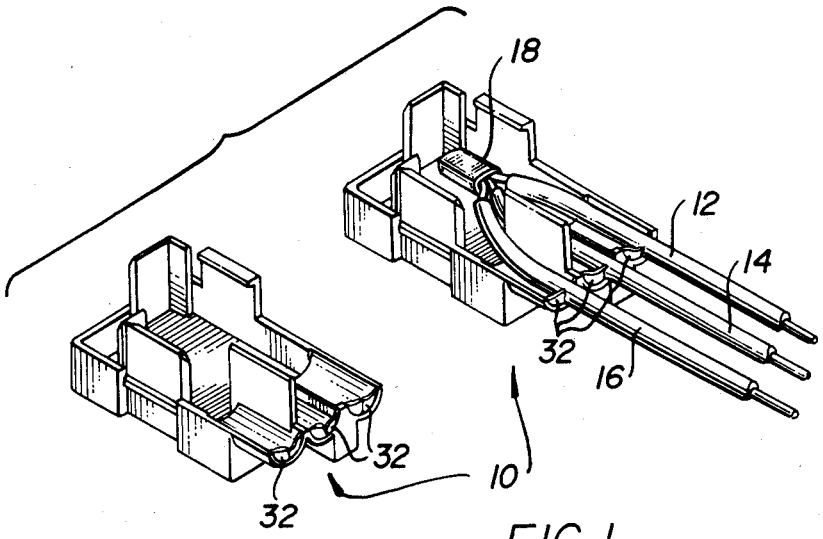
FIG. 1 is a perspective representation of two half-sections of the housing of the invention in a disassembled position, with cables extending into one of the half-sections with wire conductors spliced together by an appropriate crimping sleeve.
Figure 2:
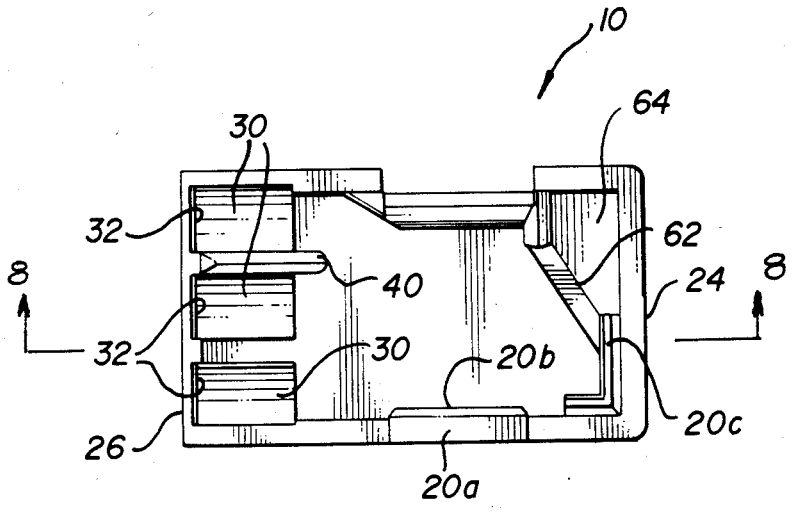
FIG. 2 is a top plan view of one of the half-sections of FIG. 1.
Figure 3:
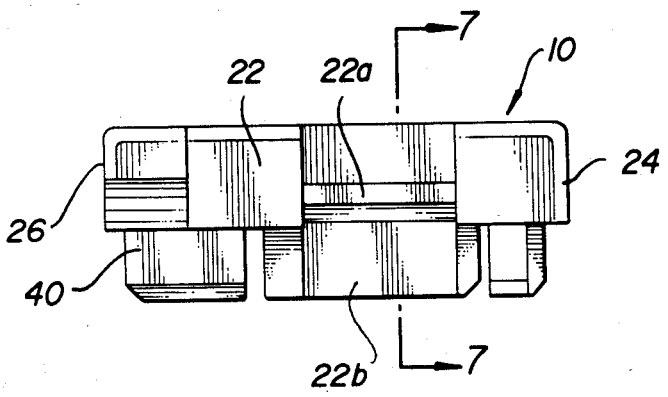
FIG. 3 is a side elevation from one side of the half-section.
Figure 4:
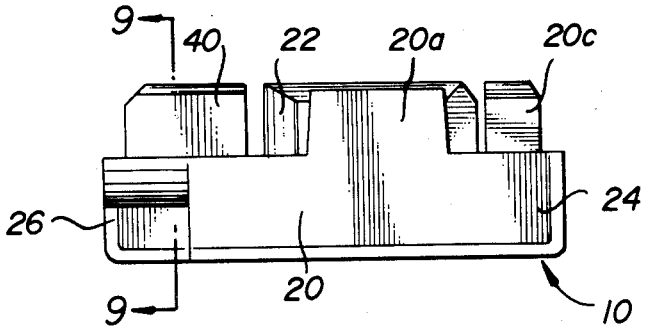
FIG. 4 is a side elevation from the other side of the half-section.

In the perspective view of FIG. 1, each of the half-sections is designated 10 and, as mentioned above, the half-sections are identical. As also mentioned, the half-sections 10 are preferably formed of molded thermoplastic material. Three electric cables 12, 14 and 16 are shown as extending into one of the half-sections 10, with the bare wires of the respective cables being spliced together by a crimping sleeve 18.

Each of the half-sections is pre-filled with a gel which, as described above, is preferably a particular type of silicone based polymer which is highly adhesive, and yet has a consistency such that it will not flow out of the half-sections after it has set.

After the cables 12, 14 and 16 have been placed in one of the half-sections 10, the other half-section is inverted over the top of the first half-section and is squeezed into a snap-fit with the first half-section. The resulting displacement of the gel around the crimped ends of the cables and throughout the interior of the housing forms an effective waterproof seal. Also, the two half-sections of the housing are rigidly held together and have no tendency to separate during use. However, if so desired, they can be pried apart with an appropriate tool.

The configuration of the half-section 10 is shown in FIGS. 2–9. As mentioned above, all of the half-sections are identical to one another. Each half-section is formed, for example, of molded thermoplastic, as mentioned above. Each half-section 10, as shown in FIGS. 2–9, forms an open container for the gel, the container having side walls 20 and 22, and end walls 24 and 26. The container also has a bottom 28.

Figure 5:
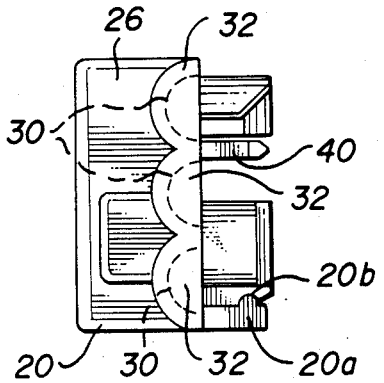
FIG. 5 is an end view of the half-section.
Figure 6:
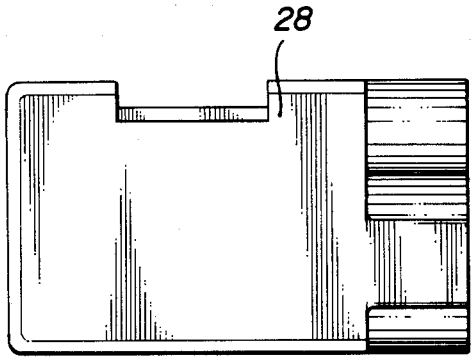
FIG. 6 is a bottom view of the half section.
Figure 7:
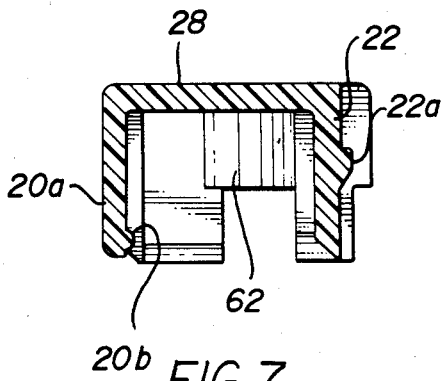
FIGS. 7, 8 and 9 are sections taken along the lines 7—7, 8—8 and 9—9 of FIGS. 3, 2 and 4 respectively.
Figure 8:
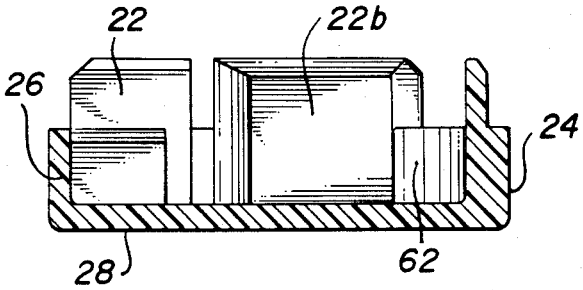
Figure 9:
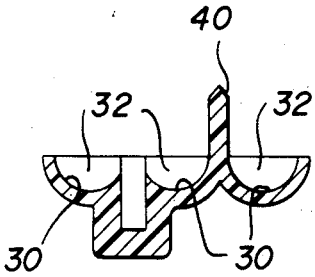

A number of troughs 30 are formed in end wall 26, as best shown in FIGS. 5 and 9. These troughs, as explained above, provide a means of entry into the housing of the wires to be spliced. Thin frangible dams 32 are molded to the outer ends of the troughs, and these dams, as explained above, serve as a means for keeping the gel in the container during filling, while the gel is in liquid form, and also to permit the gel to form on the bottom of the troughs to assist in the sealing operation.

Side wall 20 of the container includes an upper portion 20*a* provided with a lip 20*b* which extends over a rib 22*a* in the wall 22 of the other half-section into a snap-fit engagement so that the two half-sections are rigidly held together.

Side wall 22 also has a blade-like extension 22*b* which extends down into the side of the mating container and into the gel contained in the mating container. This blade enters the gel in the mating container and forces it toward the center of the cavity to assure that the gel will surround the crimped wires of the cables. As mentioned above, the blades also serve a second function of preventing the half-sections from nesting into adhesive contact with the gel contained therein during bulk handling.

The container also includes an interlocking divider 40 which extends between each pair of cables in the grooves 32, as shown in FIG. 1, and serves to prevent the cables from being pulled out of the housing. A diagonal wall 62 (FIG. 2) is formed in the container adjacent to wall 24 to form a cavity 64, and wall 20 includes a projecting portion 20*c* which is received in the cavity 64 of the other half-section and which functions as a guide.

The invention provides, therefore, a waterproof housing which is intended to protect the splices of buried electrical cables such as are used, for example, in irrigation control systems.

As described above, the waterproof housing of the invention is formed of two like molded thermoplastic half-sections which are constructed to snap together around the crimped splice of two or more cables when the half-sections are pressed against one another.

Each half-section is pre-filled with a plastic insulating gel which becomes adhesively attached to the crimping sleeve of the splice and which forms a perimeter seal around the splice. As also described, troughs are formed at one end of each half-section as a means of entry for the cables to be spliced, and thin frangible dams are molded onto the outer ends of the troughs to maintain the gel in the half-sections during filling.

It will be appreciated that while a particular embodiment of the invention has been shown and described, modifications may be made. It is intended in the claims to cover all modifications which come within the true spirit and scope of the invention.

I claim:

1. A housing for protecting the spliced ends of two or more electric cables, said housing being formed of two identical half-sections engaging one another in a snap-fit relationship, with said half-sections being configured to form entries therebetween for the cables, each of said half-sections being pre-filled with a silicone-based gel material, each of said half-sections having the shape of an open-topped rectangular container having side walls, end walls, and a bottom, one of the end walls having a plurality of troughs extending therethrough to provide said entries for the cables, one of said side walls having a lip formed at the outer edge thereof and the other of said side walls having a shoulder formed thereon to enable the lip of one of the half-sections to engage the shoulder of the other of the half-sections to provide the snap-fit relationship between the half-sections, in which the other of said side walls includes an inwardly displaced intermediate section extending upwardly beyond the edge thereof to form a blade which extends into the gel in the other of the half-sections to displace the gel towards the spliced ends of the electric cables when supported in the housing.

* * * * *